US007469555B2

(12) United States Patent
Taras et al.

(10) Patent No.: US 7,469,555 B2
(45) Date of Patent: Dec. 30, 2008

(54) MULTIPLE CONDENSER REHEAT SYSTEM WITH TANDEM COMPRESSORS

(75) Inventors: Michael F. Taras, Fayetteville, NY (US); Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 337 days.

(21) Appl. No.: 10/978,975

(22) Filed: Nov. 1, 2004

(65) Prior Publication Data

US 2006/0090507 A1 May 4, 2006

(51) Int. Cl.
*F25B 41/00* (2006.01)

(52) U.S. Cl. ..... 62/513; 62/510

(58) Field of Classification Search ..... 62/506, 62/507, 510, 513

See application file for complete search history.

(56) References Cited

U.S. PATENT DOCUMENTS 5,875,637 A * 3/1999 Paetow ..... 62/117
6,378,318 B1 * 4/2002 Jin ..... 62/238.7
6,381,970 B1 * 5/2002 Eber et al. ..... 62/90
6,705,093 B1 * 3/2004 Taras et al. ..... 62/90
2006/0053821 A1 * 3/2006 Taras et al. ..... 62/324.1
2006/0080984 A1 * 4/2006 Lifson et al. ..... 62/228.5
2006/0090502 A1 * 5/2006 Taras et al. ..... 62/510

* cited by examiner

*Primary Examiner*—Melvin Jones
(74) *Attorney, Agent, or Firm*—Carlson, Gaskey & Olds

(57) ABSTRACT

A tandem compressor system is utilized that receives refrigerant from a common suction manifold, and from a common evaporator. From the compressors, the refrigerant passes to a plurality of condensers, with each of the condensers being associated with a separate zone for heat rejection, preferably at different temperature levels. Each of the condensers is associated with at least one of the plurality of compressors. A reheat coil is associated with the evaporator to improve comfort level in the environment to be conditioned. Multiple reheat circuits associated with separate condensers are employed to provide various stages of reheat or to condition separate environments. By utilizing the common evaporator, a plurality of condensers, and the reheat coils, the ability to independently control temperature, humidity and amount of heat rejection to a number of zones is achieved without the requirement of having dedicated circuits with multiple additional components. Thus, the overall system cost and complexity is significantly reduced and its operational and control flexibility is improved.

13 Claims, 2 Drawing Sheets

MULTIPLE CONDENSER REHEAT SYSTEM WITH TANDEM COMPRESSORS

BACKGROUND OF THE INVENTION

This application relates to a refrigerant system utilizing tandem compressors sharing a common evaporator, but having separate condensers and wherein a reheat coil is incorporated into the system design.

Refrigerant systems are utilized in applications to change the temperature and humidity or otherwise condition the environment. In a standard refrigerant system, a compressor delivers a compressed refrigerant to a heat exchanger, known as a condenser, which is typically located outside. From the condenser, the refrigerant passes through an expansion device to an indoor heat exchanger, known as an evaporator. In the evaporator, moisture may be removed from the air, and the temperature of air blown over the evaporator coil is lowered. From the evaporator, the refrigerant returns to the compressor. Of course, basic refrigerant cycles are utilized in combination with many configuration variations and optional features. However, the above provides a brief understanding of the fundamental concept.

In more advanced refrigerant systems, a capacity of the air conditioning system can be controlled by the implementation of so-called tandem compressors. The tandem compressors are normally connected together via common suction and common discharge manifolds. From a single common evaporator, the refrigerant is returned through a suction manifold, and then distributed to each of the tandem compressors. From the individual compressors the refrigerant is delivered into a common discharge manifold and then into a common single condenser. The tandem compressors are also separately controlled and can be started and shut off independently of each other such that one or both compressors may be operated at a time. By controlling which compressor is running, control over the capacity of the combined system is achieved. Often, the two compressors are selected to have different sizes, such that even better capacity control is provided. Also, tandem compressors may have shutoff valves to isolate some of the compressors from the active refrigerant circuit, when they are shutdown. Moreover, if these compressors operate at different saturation suction temperatures, pressure equalization and oil equalization lines are frequently employed.

One advantage of the tandem compressor system is that better capacity control is provided, without the requirement of having each of the compressors operating on a dedicated circuit. This reduces the system cost.

Tandem compressors provide untapped potential for even greater control. The tandem compressors have not been provided in many beneficial combinations that would be valuable.

In some cases, while the system is operating in a cooling mode, the temperature level at which the air is delivered to provide comfort environment in a conditioned space may need to be higher than the temperature that would provide the ideal humidity level. Generally, the lower the temperature of the evaporator coil more moisture can be removed from the air stream. These opposite trends have presented challenges to refrigerant system designers. One way to address such challenges is to utilize various schematics incorporating reheat coils. In many cases, a reheat coil placed in the way of an indoor air stream behind the evaporator is employed for the purposes of reheating the air supplied to the conditioned space after it has been cooled in the evaporator, where the moisture has been removed as well.

While reheat coils have been incorporated into air conditioning systems, they have not been utilized in an air conditioning system having an ability to operate at multiple temperature levels.

SUMMARY OF THE INVENTION

In this invention, as opposed to the conventional tandem system, at least some of the tandem compressors will not have a common discharge manifold connecting these tandem compressors together. Each of these tandem compressors is connected to its own condenser, while the same compressors are still connected to a common suction manifold and a single evaporator. Consequently, for such tandem compressor system configurations, additional temperature levels of heat rejection, associated with each condenser, become available. An amount of refrigerant flowing through each condenser can be regulated by flow control devices placed at the compressor discharge ports as well as by controlling related expansion devices or utilizing other control means, such as condenser airflow. Further, a reheat function is provided by a reheat circuit that includes a reheat coil associated with and placed behind the evaporator.

The present invention, by providing separate condensers, allows for heat rejection at two different temperature levels and to two different zones. As an example, a first condenser could be associated with an outdoor zone, while the second condenser is associated with an indoor zone that would be preferably at a different temperature. By controlling the temperature at which heat is rejected, the amount of the refrigerant passing from that condenser can be tightly controlled. One possible application would be to utilize one of the condensers to prevent excessive frost formation (defrost operation), with the other condenser being operable in a conventional manner as in normal air conditioning installations. Another possible application is to utilize this invention in heat pump systems where heating of two separate environments requiring different levels of heating is desired. In this case, each condenser can be employed to provide heating to each environment. Many other applications such as air stream reheat in dehumidification applications or space heating are also feasible.

Integration of the reheat coil into the system design provides the additional flexibility of lowering the temperature of air passing over the evaporator to remove moisture, and then reheating the air back to a desired temperature. Several reheat schemes are disclosed. However, it should be understood that the fundamental concept of this invention is the incorporation of a reheat cycle into a refrigerant system having tandem compressors delivering refrigerant to multiple condensers, preferably operating at different temperature levels, and accepting refrigerant from a common evaporator. The particular refrigerant system provides a wide variety of options for the reheat function in terms of the reheat concept and position of the reheat coil in relationship to the condenser and evaporator.

These and other features of the present invention can be best understood from the following specification and drawings, the following of which is a brief description.

DETAILED DESCRIPTION OF THE PREFERRED EMBODIMENT

Figure 1:
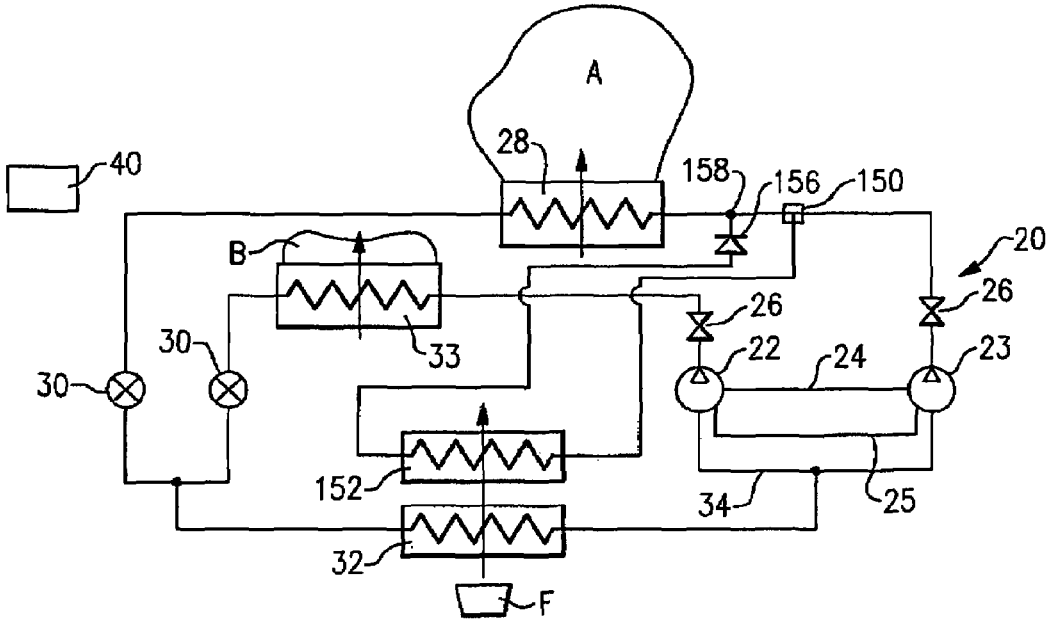
FIG. 1 is a first schematic.

A refrigerant system 20 is illustrated in FIG. 1 having a pair of compressors 22 and 23 that are operating generally as tandem compressors. A pressure equalization line 24 and an oil equalization line 25 may connect the two compressors 22 and 23, as known. Optional flow control devices such as valves 26 are positioned downstream on a discharge line associated with each of the compressors 22 and 23. These valves can be controlled to prevent high to low leak through the compressor that is not operational. That is, if for instance the compressor 22 is operational with the compressor 23 stopped, then the valve 26 associated with the compressor 23 will be closed. The valves 26 can be of a conventional shutoff or adjustable type. In a latter case, additional flexibility in system control and operation can be provided by controlling the valves 26.

Refrigerant from the compressor 23 travels to a condenser 28. The refrigerant continues downstream and through an expansion device 30. From the expansion device 30, the flow passes through an evaporator 32. The refrigerant passing through the evaporator 32 passes to a suction manifold 34 leading back to the compressors 22 and 23. The refrigerant from the compressor 22 passes through a condenser 33. The refrigerant also passes through an expansion device 30 and then returned through the evaporator 32 and suction manifold 34 back to the compressors 22 and 23.

The present invention, by providing separate condensers, allows heat rejection at two different temperature levels and to two different zones A and B. As an example, a first condenser could be associated with an outdoor zone A, while the second condenser is associated with the indoor zone B that would be at a different temperature. Of course, the fluid flows (e.g. air flow) over these condensers would be different fluid flows, as they are moving into different zones. By controlling the temperature at which heat is rejected, the amount of the refrigerant passing through that condenser can be tightly controlled. One possible application would be to utilize one of the condensers to prevent excessive frost formation (defrost operation), with the other condenser being operable in a conventional manner as in normal air conditioning installations. Many other applications, such as air stream reheat in dehumidification applications or space heating, are also feasible.

A reheat schematic is incorporated into the refrigerant system 20. It should be understood that while specific reheat schematics may be disclosed, any other reheat option can be utilized within the present invention. Thus, the reheat circuit design options such as the location of where the reheat fluid is tapped or position of the reheat coil in relationship to the condenser and evaporator can be modified in various schematics, according to this invention. In the FIG. 1 schematic, a hot gas reheat concept is utilized, with the reheat coil 152 is shown as communicating with a three-way valve 150 for tapping refrigerant from a location upstream of the condenser 28. The refrigerant flows through the reheat coil 152, which is placed in the path of airflow from the air-moving device such as fan F across the evaporator 32. The refrigerant returns through a check valve 156 to a return point 158 also upstream of the condenser 28, such that the reheat coil is in a series configuration with the condenser 28. The reheat function is utilized as known to allow removal of moisture while still maintaining a desired temperature.

A control 40 for the refrigerant system 20 is operably connected to control the compressors 22 and 23, the expansion devices 30, the discharge valves 26 and the three-way valve 150. By properly controlling each of these components in combination, the conditions at each condenser 28 and 33 can be controlled as necessary for the sub-environments A and B. The exact controls necessary are as known in the art, and will not be explained here. However, the use of the tandem compressors 22 and 23 utilizing a common evaporator 32 but separate condensers, preferably operating at different temperature levels, reduces the number of components necessary for providing the independent control for the heat rejection to zones A and B, and thus is an improvement over the prior art. Also, use of the reheat function provides an improved temperature and humidity control.

Also, as mentioned above, the valves 26 can be of a conventional on/off or adjustable type, with the valve control executed through pulsation or modulation. Furthermore, the three-way valve 150 can be of a standard shutoff or adjustable design, once again controlled by a modulation or pulsation technique, and can be substituted by a pair of conventional valves. In such cases even more flexibility in system control and operation can be achieved.

Figure 2:
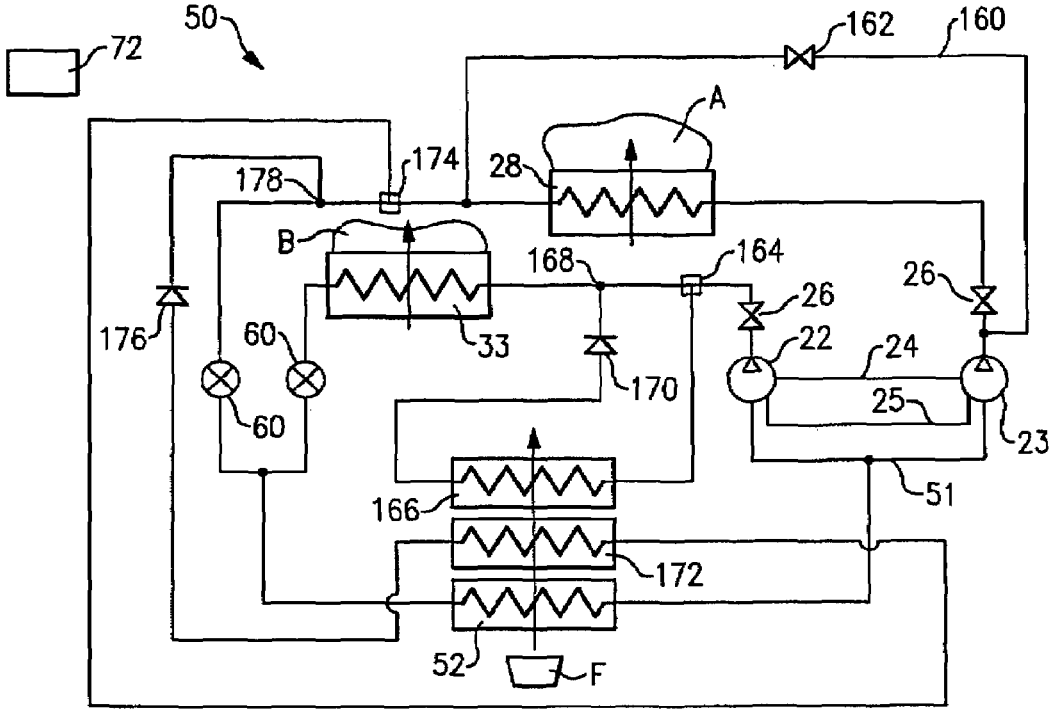
FIG. 2 is a second schematic.

FIG. 2 shows a more complicated refrigerant system 50 for rejecting heat to zones A and B. As shown, a single evaporator 52 communicates with a common suction manifold 51. Compressors 22 and 23 are connected as in the prior embodiment.

From the compressors 22 and 23, the refrigerant passes to condensers 25 and 33 and then through separate expansion devices 60, and to evaporator 52. As is shown, the condenser 33 rejects heat to zone B, and the condenser 28 rejects heat to zone A. Again, a control 72 is provided that controls each of the components to achieve the desired conditions within each of the condensers 28 and 33 and subsequently in corresponding zones A and B.

A bypass line 160 including a bypass flow control device such as valve 162 allows refrigerant to be bypassed around the condenser 28. Such a bypass would be utilized when dehumidification is desired with reduced sensible load of the air delivered into an environment to be conditioned. The refrigerant cycle 50 incorporates two distinct reheat circuits, with a first reheat circuit once again utilizing the hot gas reheat concept and having a reheat coil 166 receiving refrigerant from a three-way valve 164 positioned upstream of the condenser 33. Refrigerant having passed through the reheat coil 166 is returned to a main circuit at a point 168, also upstream of the condenser 33, through a check valve 170. A second reheat circuit employs a warm liquid or two-phase refrigerant reheat concept and has a reheat coil 172 that receives refrigerant from a three-way valve 174 positioned downstream of the condenser 28. The refrigerant having passed through the reheat coil 172 passes through a check valve 176 and is returned to the main circuit at a point 178. As mentioned above, while the reheat circuits shown in FIG. 2 employ specific design concepts and schematics, with the specific positions of the reheat coils relative to each other as well as to the respective condensers and evaporator, other configurations within the refrigerant system 50 are also feasible. Moreover, the control 72 will select how to operate the reheat coils 166 and 172 in combination or independently to achieve a desired temperature of the air having passed over the evaporator 52, and then the reheat coils 166 and 172 before entering an environment to be conditioned. In such circumstances, various reheat stages can be provided for the refrigerant system 50 improving comfort in the environment to be conditioned. Obviously, the reheat coils 166 and 172 can be associated with a single condenser 28 or 33 if desired.

The individual control steps taken to achieve desired operating conditions in each of the condensers would be known. It is the provision of the combined system utilizing a common evaporator in combination with the tandem compressors, separate condensers and reheat coils that is inventive here.

Of course, other multiples of compressors and compressor banks as well as condensers and reheat coils can be utilized within the scope of this invention.

Although preferred embodiments of this invention have been disclosed, a worker of ordinary skill in this art would recognize that certain modifications would come within the scope of this invention. For that reason, the following claims should be studied to determine the true scope and content of this invention.

Figure 3:
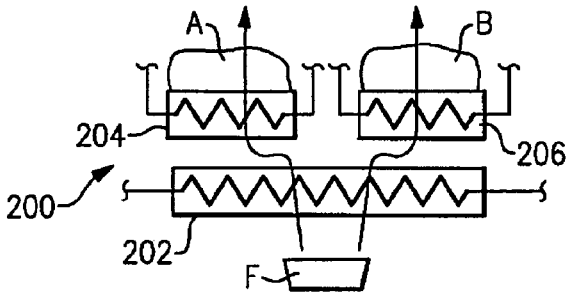
FIG. 3 shows an option.

FIG. 3 shows a refrigerant system 200, wherein an evaporator 202 is provided with two spaced reheat coils 204 and 206 treating separate portions of air having passed over the evaporator 202. As shown, the reheat coils 204 and 206 can be associated with distinct environments A and B if desired. By controlling the flow of the refrigerant into the two reheat coils 204 and 206, the conditions of air being directed into the individual environments A and B can be accurately controlled. In all other aspects the FIG. 3 embodiment is similar to the schematic shown in FIG. 2.

Figure 4:
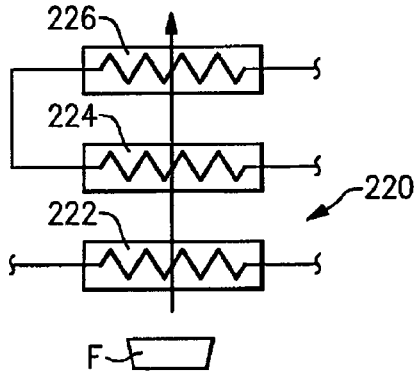
FIG. 4 shows another option.

FIG. 4 shows an embodiment 220, wherein an evaporator 222 is associated with a pair of reheat coils 224 and 226. As can be seen, the reheat coils 224 and 226 are in a serial flow relationship, and receive refrigerant flow from a common point in the refrigerant cycle. Hence, both reheat coils 224 and 226 employ similar reheat concepts, but the refrigerant flowing through each coil would have a different thermodynamic state and consequently would provide different amount of reheat. Obviously, as in the FIG. 3 embodiment, the reheat coils 224 and 226 can be placed side-by-side behind the evaporator 222 to treat separate portions of the airflow.

Figure 5:
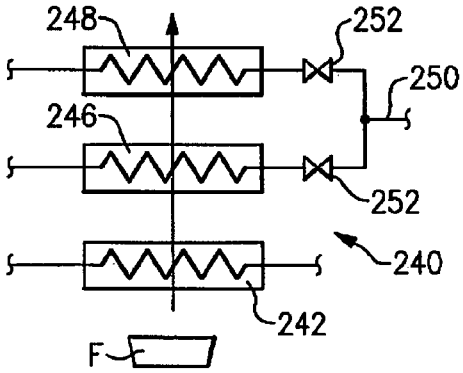
FIG. 5 shows another option.

FIG. 5 shows a system 240, wherein an evaporator 242 is associated with a pair of reheat coils 246 and 248. As can be seen, a common supply line 250 for the refrigerant flowing into the reheat coils 246 and 248 is utilized, however, the reheat coils 246 and 248 receive the refrigerant in a similar thermodynamic state and in a parallel flow relationship, providing stages of reheat. Refrigerant passes through a flow control devices such as valves 252 on its way to the reheat coils 246 and 248 such that one or the other reheat coil can be shut off or refrigerant flow can be controlled to each reheat coil independently. Once again, the reheat coils 246 and 248 can be located side-by-side behind the evaporator 242.

Figure 6:
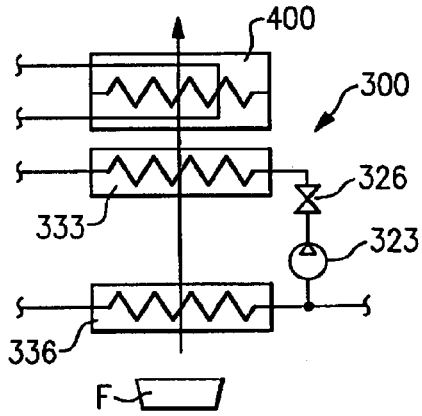
FIG. 6 shows yet another option.

Finally, FIG. 6 shows an embodiment 300, wherein an evaporator 336 is associated with a reheat coil 333, and wherein the reheat coil 333 is actually one of the condensers associated with a compressor 322 and a discharge valve 326. Again, the evaporator 336 would be associated with at least one more compressor in this embodiment. Furthermore, one of the condensers (the condenser 333 in this case) utilized as a reheat coil in this embodiment may represent only one of multiple reheat stages (coils) associated with the evaporator 336, and a conventional supplemental reheat coil 400 could also be employed here.

Notably, the various refrigerant systems disclosed in this application can all be utilized as air conditioning units or as heat pumps.

What is claimed is:

1. A refrigerant system comprising:

a plurality of compressors, where at least two of said compressors receive a refrigerant from a suction manifold leading from a common evaporator, refrigerant from said compressors then passing into a plurality of condensers, said plurality of condensers associated with said plurality of said compressors, where said at least two compressors are connected to separate ones of said condensers; and an evaporator receiving refrigerant from said plurality of condensers, said evaporator being positioned relative to a reheat coil such that at least a portion of the air having gassed over said evaporator will pass over said reheat coil.

2. The refrigerant system as set forth in claim 1, wherein a separate expansion device is positioned to receive refrigerant downstream of said plurality of condensers.

3. The refrigerant system as set forth in claim 1, wherein at least one of said compressors has a flow control device on a discharge line leading to a corresponding one of said plurality of condensers.

4. The refrigerant system as set forth in claim 3, wherein said flow control device is of an adjustable type by one of modulation and pulsation control.

5. The refrigerant system as set forth in claim 1, wherein said at least one reheat coil includes at Least two reheat coils, with said two reheat coils receiving refrigerant from distinct locations in the refrigerant cycle.

6. The refrigerant system as set forth in claim 5, wherein said reheat coils treat the same portion of air.

7. The refrigerant cycle as set forth in claim 1, wherein said reheat coil is connected to be in a serial flow relationship with at least one of said condensers.

8. The refrigerant system as set forth in claim 7, wherein said reheat coil receives refrigerant from a location upstream of at least one of said plurality of condensers.

9. The refrigerant system as set forth in claim 7, wherein said reheat coil receives refrigerant from a location downstream of at least one of said plurality of condensers.

10. The refrigerant system as set forth in claim 1, wherein the refrigerant system is operated as an air conditioning system.

11. The refrigerant system as set forth in claim 1, wherein said refrigerant system is operated as a heat pump.

12. The refrigerant system as set forth in claim 1, wherein at Least two of said plurality of condensers are associated with two distinct zones at two different temperature levels.

13. The refrigerant system as set forth in claim 12, wherein different air streams pass over said at least two condensers.

* * * * *

UNITED STATES PATENT AND TRADEMARK OFFICE

CERTIFICATE OF CORRECTION

PATENT NO. : 7,469,555 B2
APPLICATION NO. : 10/978975
DATED : December 30, 2008
INVENTOR(S) : Taras et al.

It is certified that error appears in the above-identified patent and that said Letters Patent is hereby corrected as shown below:

Claim 1, Column 6, Line 14: “gassed” should read as --passed--

Claim 5, Column 6, Line 27: “Least” should read as --least--

Claim 12, Column 6, Line 47: “Least” should read as --least--

Signed and Sealed this

Seventeenth Day of March, 2009

JOHN DOLL
*Acting Director of the United States Patent and Trademark Office*